United States Patent [19]

Dolinar et al.

[11] Patent Number: 4,797,667

[45] Date of Patent: Jan. 10, 1989

[54] SPLIT SCREEN ELECTRODE STRUCTURE FOR TFEL PANEL

[75] Inventors: Brian J. Dolinar, Lake Oswego; Robert T. Flegal, Beaverton; Larry L. Lewis, Portland, all of Oreg.

[73] Assignee: Planar Systems, Inc., Beaverton, Oreg.

[21] Appl. No.: 116,630

[22] Filed: Nov. 2, 1987

Related U.S. Application Data

[62] Division of Ser. No. 729,974, Apr. 30, 1985, Pat. No. 4,739,320.

[51] Int. Cl.[4] ..... G09G 3/30

[52] U.S. Cl. ..... 340/781; 340/719; 340/774

[58] Field of Search ..... 340/781, 718, 719, 784, 340/774

[56] References Cited

U.S. PATENT DOCUMENTS

| | | | |
|---|---|---|---|
| 3,048,824 | 8/1962 | Thompson | 340/781 |
| 3,209,229 | 9/1965 | Cox, Jr. | 340/781 |
| 3,882,355 | 5/1975 | De Witt | 340/718 |
| 4,231,640 | 11/1980 | Funada et al. | 340/784 |
| 4,238,793 | 12/1980 | Hochstrate | 340/781 |
| 4,308,534 | 12/1981 | Yamamoto | 340/784 |
| 4,448,490 | 5/1984 | Shibuya et al. | 340/784 |

*Primary Examiner*—Marshall M. Curtis

*Attorney, Agent, or Firm*—Chernoff, Vilhauer, McClung & Stenzel

[57] ABSTRACT

An electrode structure for an AC matrix-addressed TFEL panel includes top and bottom sets of scanning electrodes, each located in a respective half of the panel, and top and bottom sets of data electrodes extending at right angles to the scanning electrodes where each electrode in the top and bottom set extends for a distance slightly less than halfway across the panel to provide a split screen display. The scanning electrodes are driven by driver amplifiers that simultaneously energize complimentary pairs of the scanning electrodes in the top and bottom halves of the panel driving them in line-by-line fashion. The top and bottom sets of data electrodes are driven simultaneously by top and bottom sets of electrode drivers simultaneously with each scan of the data electrodes. In this way the top and bottom halves of the panel are scanned simultaneously, and the writing of one frame of data is faster. Also, the column electrodes are shorter and therefore require less energy and consume less power per frame.

3 Claims, 2 Drawing Sheets

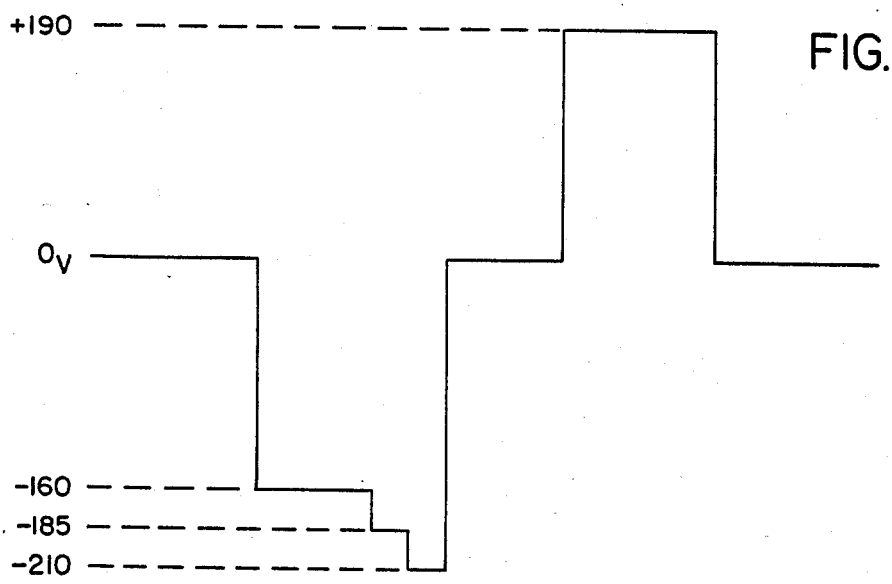
FIG. 4
FIG. 5
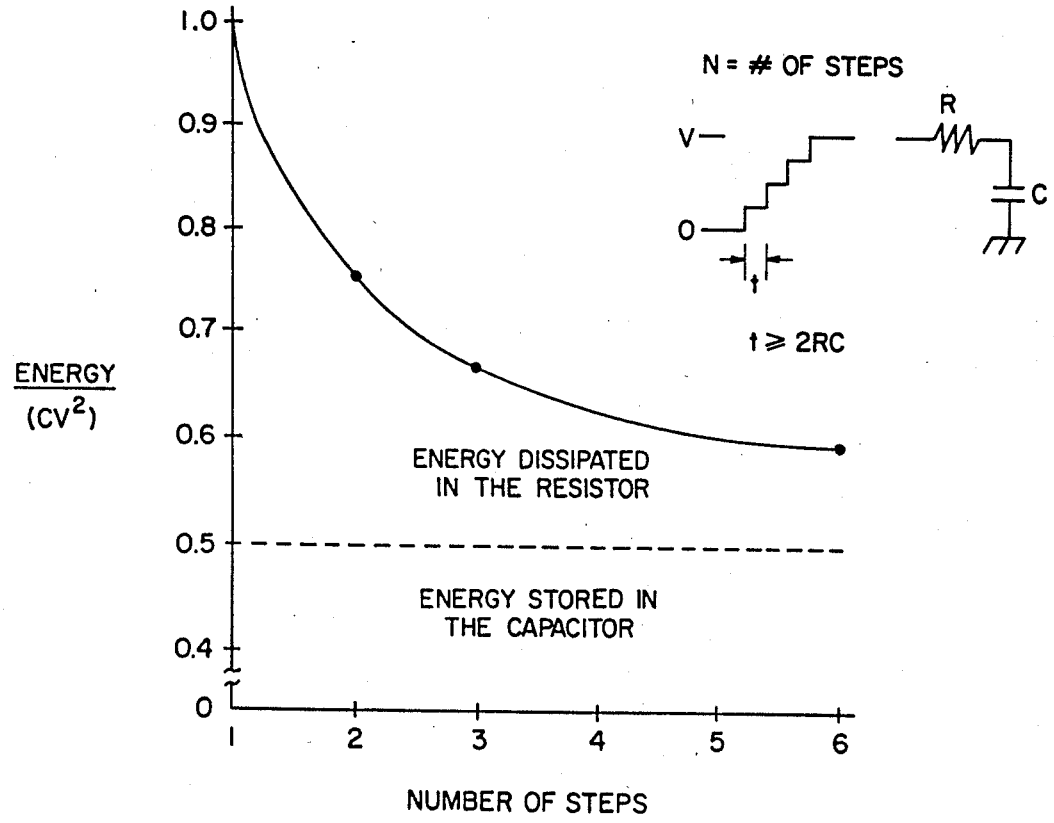

SPLIT SCREEN ELECTRODE STRUCTURE FOR TFEL PANEL

This application is a division of my copending application Ser. No. 729,974 filed Apr. 30, 1985 now U.S. Pat. No. 4,739,320 and assigned to the same assignee.

BACKGROUND OF THE INVENTION

The following invention relates to a driving architecture for a thin-film electroluminescent (TFEL) display panel comprising a matrix of luminescent pixels.

TFEL display panels are relatively thin panels for use with computer-based systems for displaying both graphic and alphanumeric data. The typical TFEL display panel includes two sets of orthogonally-disposed elongate electrodes usually referred to as scanning and data electrodes, respectively, separated by dielectric layers, and a layer of luminescent material such as ZnS sandwiched between the dielectric layers. The intersections between the two sets of orthogonally-disposed scanning and data electrodes comprise a matrix of pixels which form electroluminescent spots on the display panel. The pixels emit light when the voltage across both electrodes defining each pixel in the matrix assumes an appropriate voltage level sufficient to create an electric field which will cause the ZnS layer to emit light.

The arrays of scanning and data electrodes, respectively, are driven by individual integrated circuit driving amplifiers. These IC's present a largely ( resistive load to the driving voltage sources. Since the scanning and data electrodes are separated by dielectric layers, the pixels (the intersections between scanning and data electrodes) are capacitive. Electrically, the display panel can thus be modeled as an RC network. Each pixel point reached by each electrode represents a resistance in parallel with a capacitance between it and the adjacent crossing electrode, which may be modeled as a single series RC network for the entire panel.

This electric configuration poses two primary problems for the designer. First, being an RC network, the capacitor element requires a finite time to charge to a voltage level sufficient to cause luminescence of the pixel. Second, the power consumed by the panel varies with the square of the charging voltage. This results from the following analysis:

If an ideal stepped voltage source drives this RC network, the energy stored in the capacitive element after a time T is:

$$W_C = \tfrac{1}{2} CV^2.$$

As the capacitive element charges, current flows through the resistive element and the energy dissipated in the resistor is:

$$W_R = \int_0^\infty iRdt,$$

where $i=(R/V)e^{-t/RC}$.

Evaluation of the integral gives the result:

$$W_R = \tfrac{1}{2} CV^2.$$

Combining the energy stored in the capacitor, and the energy dissipated through the resistor gives the total amount of energy drawn from a voltage source charging the panel as:

$$W_{TOT} = CV^2.$$

If the capacitor is then discharged to ground through the series resistance, the stored energy of $\frac{1}{2}$ $CV^2$ is dissipated in the resistance and thus the entire amount of energy supplied by the voltage source is converted to heat.

Data is generally written on a TFEL panel by precharging the row electrodes a line at a time, to a voltage level just below the threshold level of luminescence. As each line electrode is charged or scanned, a set of data pulses are placed on each of the column electrodes in selective fashion to energize preselected pixels in that line. The data voltage, frequently referred to as a modulation voltage, raises the voltage level of the pixels along the precharged row electrode past the point of luminescence. The modulation voltage component is responsible for the largest share of the panel's power consumption because it is necessary to apply the modulation voltage to an entire column for each line written; and if there are 256 rows, each column may be charged a maximum of 256 times to complete one frame of data.

A frame of data is defined as the data written on the screen during one sequential scan of all the rows. Since power is equal to work per unit time, the power required to charge the row electrodes during a single frame is a function of the row electode capacitance times the scanning frequency or $P=fCV^2$. If there are to be 60 frames per second, the scanning frequency is 60. In this equation, the composite row electrode capacitance C is the sum of the capacitance of all of the individual pixels in a row. This would equal the pixel capacitance times the number of columns.

The power required to charge the column electrodes as each row is written differs significantly from the amount of power required to charge a row. This is because each time a line or row is written, a significant number of columns must be fully charged. A typical TFEL screen array may contain 256 rows and 512 columns. If one assumes that, for each line of data written, approximately half of the columns receive a data pulse (thereby illuminating half of the pixels in that row), then 256 columns must be fully charged for each row that is written. Typically, the voltage used to precharge the rows (commonly referred to as the write voltage) is on the order of 160 volts. Also typical for this type of addressing scheme is a 50 volt requirement for the modulation voltage. Even though the write voltage is more than three times the modulation voltage, the modulation voltage component consumes the most power because of the aforementioned requirement that a significant number of columns must be charged for each row to be written. Thus it turns out that the power consumed by the charging of the column electrodes during each frame is significantly higher than the power consumed in the precharging step. With a larger screen, this problem is exacerbated because more electrodes would be necessary to maintain the same degree of optical resolution. More data electrodes increase the amount of power consumption.

Energy savings could be utilized during the modulation step if enough time were available to effect a slower charging rate. A slower charging rate will result in less energy being dissipated in the resistive component of the RC line. For example, such an energy-saving technique is disclosed in Ohba, U.S. Pat. No. 4,338,598. In the Ohba patent a precharge voltage is applied to opposite sets of electrodes in two steps, half of the precharge voltage being applied to the scanning electrodes, and half of the precharge voltage being applied to the data electrodes. This technique, however, may extract a penalty in the form of the time required to execute it which may in turn require that the scanning rate or number of frames of data per second, be reduced. This occurs because a finite time is required to charge a column, and the entire length of the column must be charged for each selected column as each row is scanned.

It would therefore be desirable to implement power reduction techniques for reducing the amount of power consumed in driving the panel without affecting or reducing the scanning rate so that larger TFEL displays could be constructed.

SUMMARY OF THE INVENTION

The present invention provides a means of reducing the power consumption of the TFEL panel without compromising its scanning rate. This enables the use of a larger number of electrodes thus permitting a larger screen or display panel. The data electrodes, which are arranged in columns, are configured in a split-screen array. The top portion of the screen, which comprises the top half of the display, includes an electrode array in which the individual column electrodes extend slightly less than half way across the screen from top to bottom. Similarly, a second plurality of electrodes exists at the bottom of the display extending towards the top of the display for a distance slightly less than half the distance across the screen. A narrow gap in the middle of the screen separates the top column electrodes from the bottom column electrodes. The top and bottom arrays of electrodes are colinear with one another so that each top electrode has a corresponding bottom electrode extending in colinear fashion with it.

The split-column electrode architecture permits the data voltage or modulation voltage to be applied in multiple stepwise pulses instead of in a single pulse. This slower charging rate results in a power savings of approximately 25% if two such increases are used, and the period of each pulse is at least equal to twice the RC time constant Although a series of discrete stepwise increases in the modulation voltage requires more time, the scanning rate may remain constant because the time required for a screen having the split-column electrode architecture to complete a frame of data is less than that needed for a screen having only full-length column electrodes The shorter length split-screen column electrodes require less time to charge and the split-screen column arrays permit scanning to occur in upper and lower sectors of the screen simultaneously.

Splitting the column electrodes into top and bottom arrays permits the row or scanning electrodes to be driven in complementary pairs. Thus a single driver amplifier IC may drive a scanning electrode associated with the upper column electrode array and its complementary electrode may be associated with the lower column electrode array. In this way the number of row driver IC's is reduced to one-half of the previous number required. The available time for completing a scan of the screen is then doubled because the complementary pairs of row electrodes may be driven simultaneously. This permits data to be written on both the upper half and lower half of the screen at the same time.

A principal object of this invention is to provide an electrode architecture for a TFEL display panel which permits the use of power-saving techniques without adversely affecting the scanning rate.

A further object of this invention is to provide an electrode architecture which may accommodate a larger plurality of electrodes than heretofore available within available power consumption constraints.

Yet a further object of this invention is to provide a technique for charging the data electrodes of a TFEL display in discrete steps thereby conserving the energy consumed by the panel.

A still further object of this invention is the provision of an electrode architecture which permits both the top and bottom halves of a TFEL screen to be written simultaneously.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 4 is a waveform diagram associated with the schematic diagram of FIG. 3.

FIG. 5 is a graph illustrating the power savings available using the circuit of FIG. 3.

DETAILED DESCRIPTION OF THE INVENTION

Figure 1:
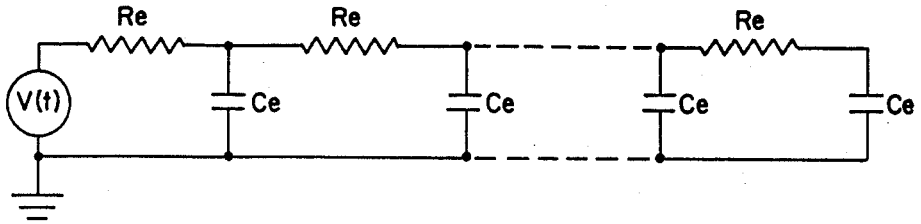
FIG. 1 is a schematic diagram of a circuit model for a typical column electrode on a TFEL display panel.
Figure 1A:
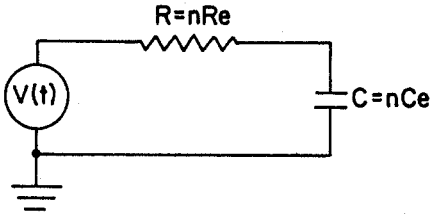
FIG. 1*a* is a schematic diagram of a circuit model of a on a TFEL display panel including illustrative formulas defining the terms labelled on the panel.
Figure 2:
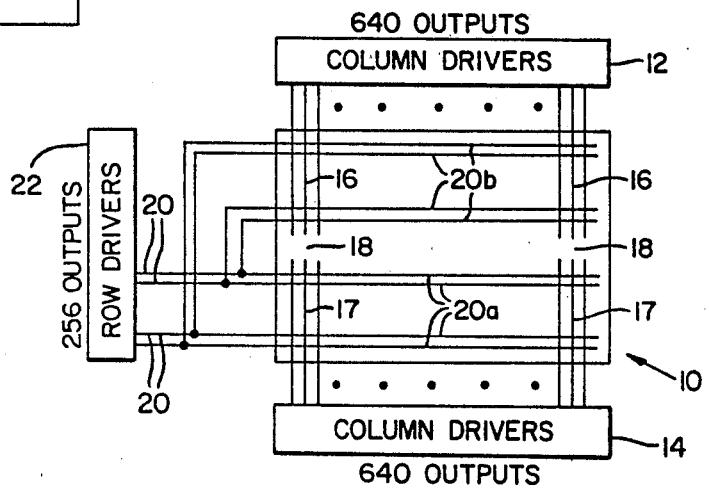
FIG. 2 is a simplified schematic diagram of a driving architecture for a TFEL panel constructed according to the invention.

A typical column electrode in a TFEL panel may be represented as a succession of series-connected RC networks as shown in FIG. 1. Each electrode including its driver IC is represented by a resistance Re. Where the column electrodes intersect with row electrodes on the panel, capacitance is created and is represented in FIG. 1 by capacitors Ce. The circuit of FIG. 1 can be modeled as a single RC network as illustrated in FIG. 2. In FIG. 2 resistor R is equal to nRe and capacitor C is equal to nCe where n is the number of pixels. The number of pixels will be equal to the number of scanning electrodes multiplied by the number of data electrodes. Typically the scanning electrodes are arranged in rows from top to bottom across the screen and the data electrodes are arranged in columns. The scanning and data electrodes are orthogonally disposed, one with respect to the other, and sandwiched between them is an electroluminescent layer separated on either side by a dielectric layer. The dielectric insulation between the scanning and data electrodes creates the capacitive effect responsible for the individual pixel capcitances Ce.

Figure 3:
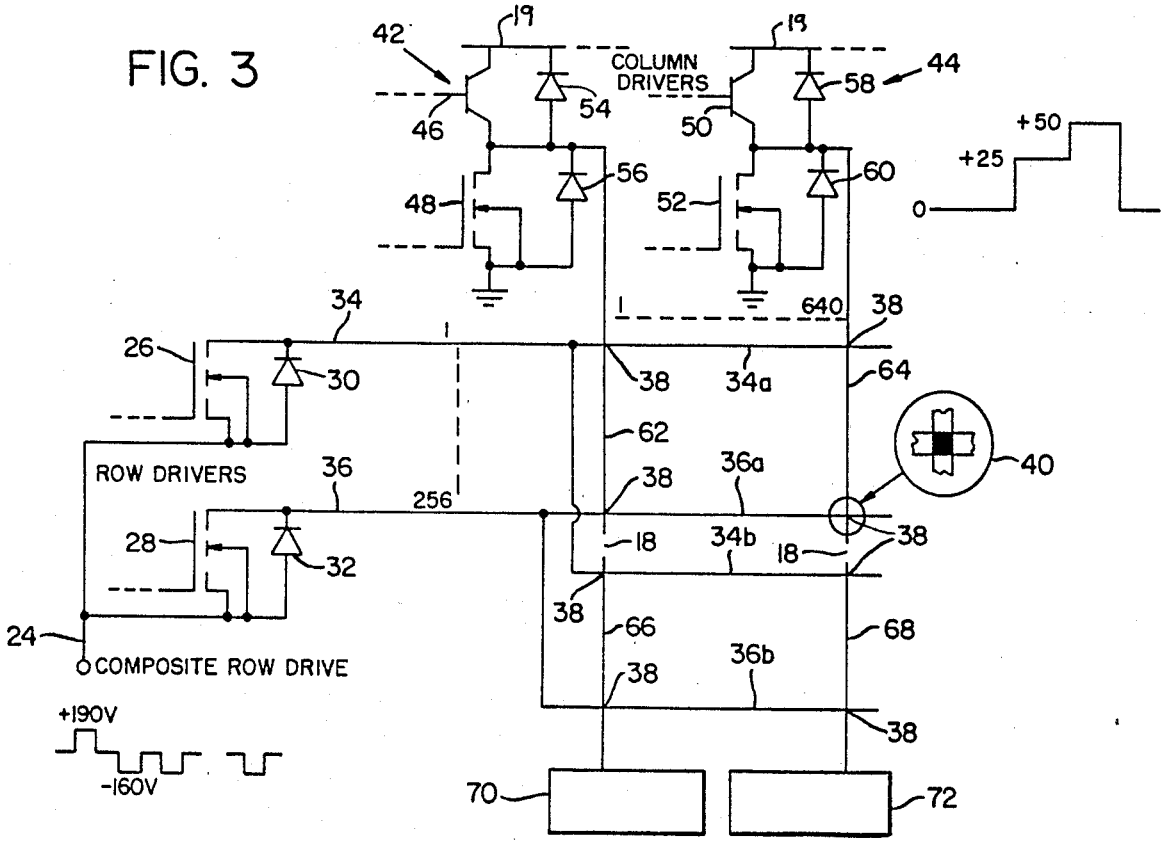
FIG. 3 is a simplified schematic diagram illustrating the electrode drivers utilized in the addressing circuitry for the display panel architecture of FIG. 2.

FIG. 3 illustrates an enlarged TFEL display constructed according to the present invention. Typically TFEL displays comprise an array of 256 scanning or row electrodes and 512 column or data electrodes. FIG. 3 provides the same resolution as achieved with the typical TFEL displays on a larger screen by increasing the number of electrodes. A TFEL display screen 10 includes top column driver circuitry 12 and bottom column driver circuitry 14. The circuits 12 and 14, respectively, drive corresponding pluralities of vertically-oriented data electrodes 16 and 17. These electrodes are in the form of complementary top and bottom pairs and each of the top electrodes 16 are colinearly aligned with corresponding bottom electrodes 17. There may be, for example, 640 columns requiring 640 upper column electrodes 16 and 640 corresponding lower column electrodes 17. The column electrode pluralities 16 and 17 extend from an edge of the screen across the screen for a distance slightly less than half the total vertical distance across the screen 10. Thus, there exists a small gap 18 between the upper plurality of electrodes 16 and the lower plurality 17.

The row electrodes, also referred to as the scanning electrodes, are arranged in complementary pairs, for example, a plurality of row electrodes 20 includes a plurality of lower branches **20*a* and a plurality of upper branches 20*b*. The row electrodes 20 are connected to a set of row driver IC's 22 comprising a set of integrated circuit amplifiers. Since there may be 512 row electrodes in the expanded screen of FIG. 2, there need only be 256 of the row driver amplifiers 22 to drive the complementary pairs of row electrodes 20*a* and 20*b***.

FIG. 3 contains a schematic diagram of a particular form of the drivers used to drive the column and row electrodes. The row drivers include a common voltage source 24 which provides voltage for a plurality of gates such as gates 26 and 28. Each gate includes a reverse diode such as diodes 30 and 32. Each driver drives an elongate electrode, and two such electrodes 34 and 36 are shown in FIG. 3, it being understood that there will be as many row electrodes as are necessary to provide the screen 10 with enough pixels 38 for sufficient optical resolution. A pixel such as pixel 38 (also illustrated as an enlarged pixel 40) is defined as the intersection of a row and column electrode. Each of the row electrodes drives two parallel branches. In FIG. 3 these are represented as branches **34*a* and 34*b* for electrode 34 and 36*a* and 36*b* for electrode 36. Thus, when driver 26 is turned on, both electrode 34*a* and 34*b*** are provided with a pulse which raises the voltage level of the pixels in each row to a point just below that of luminescence.

The row drivers receive a positive refresh pulse of 190 volts and are then scanned a line at a time with a negative 160-volt write voltage until all 256 of the row electrodes such as electrodes 34 and 36 have been scanned. The negative 160 volts preconditions pixels 38 for the application of the data voltage which is selectively applied to thecolumn drivers.

Each of the column drivers, such as drivers 42 and 44, may include a two-stage amplifier comprising transistor 46 and field effect transistor gate 48 for driver 42 and transistor 50 and field effect transistor gate 52 for column driver 44. Protection diodes 54 and 56 are provided for driver 42 and diodes 58 and 60 are provided for column driver 44. It is to be understood that there may be as many column drivers such as drivers 42 and 44 as needed to provide the degree of resolution needed for the size of the screen chosen. In the preferred embodiment which illustrates a larger size screen than has heretofore been conventionally used, there may be 640 of the column drivers such as drivers 42 and 44. Connected to each of the column drivers 42 and 44 includes a voltage source (not shown) which is selectively gated onto electrodes 62 and 64.

The proper level of luminescence will be reached by pixels 38, when the composite voltage across the pixel is approximately 210 volts (FIG. 4). Since the row electrodes are being sequentially scanned with a −160 volt signal, selective pixels 38 will be illuminated if +50 volts is placed on selected column electrodes as each row is scanned. Boosting the pixel voltage from 160 volts to 210 volts takes place in two steps. The control logic for the display panel 10 (not shown) first turns on transistor 46, thus charging electrode 62 to a level of 25 volts from supply voltage line 19. The control logic then steps the supply voltage from line 19 to +50 volts to raise the voltage level of electrode 62 to 50 volts. For pixels which are not to emit light, field effect transistor 48 is turned on while transistor 46 remains off. This prevents the pixel voltage from exceeding the luminence threshold. Electrode 62 thus will remain at 0 volts. This process is simultaneously executed on all of the selected column drivers for each sequential row that is scanned.

Since the row drivers such as drivers 26 and 28 drive complementary pairs of electrodes such as **34*a* and 34*b*, 36*a* and 36*b*, columns extending from the bottom portion of the screen such as columns 66 and 68 may be provided with data pulses at the same time that data is being provided to the electrodes 62 and 64 in the upper portion of the screen 10. The lower column electrodes 66 and 68 include column drivers 70 and 72 which will be similar in all respects to column drivers such as drivers 42 and 44. Each of the electrodes 66 and 68 will be colinear with their respective upper electrodes 62 and 64, leaving a narrow gap 18 at the center of the display screen 10**.

FIG. 5 is a graph illustrating the power savings available by impressing the modulation voltage on the column electrodes in two discrete steps. Since the energy dissipated in the resistive component of the TFEL panel is a function of the square of the voltage, it can be seen that charging the panel in discrete voltage steps results in a power savings. The energy stored in the capacitive component of the typical panel is equal to $\frac{1}{2}$ $CV^2$ and the energy dissipated in the resistive component is also equal to $\frac{1}{2}$ $CV^2$. modulation voltage, however, is impressed upon the electrodes in two steps, each of which is equal to a voltage V/2, then the energy dissipated through the resistor becomes $\frac{1}{2}\ C(V/2)^2+\frac{1}{2}\ C(V/2)^2$. Combining these two terms yields an energy dissipation of $CV^2/4$. Combining the energy stored in the capacitor and the energy dissipated through the resistor, the total energy equals $\frac{3}{4}$ $CV^2$, thus yielding a 25% savings in the amount of energy required to illuminate the panel in this fashion as opposed to a single step of 50 V. This energy savings is illustrated in FIG. 5 which shows that, as the number of adiabatic charging steps is increased, the total amount of energy required to illuminate the panel decreases. For example, a two-step adiabatic charging of the column electrodes shows that only 0.75 $CV^2$ is expended in energy.

The amount of time required to charge each column electrode increases with the number of steps utilized to charge the electrode. The duration of each step is determined by the RC time constant of the network. For maximum power reduction each step should have a period $T \geqq 2RC$. This allows the capacitor to be almost fully charged to the value of the input voltage before the voltage is changed, which minimizes the energy dissipated in the resistor. In the case of the two-step adiabatic charging process illustrated in FIG. 4, sufficient time is available because of the use of the split column electrode architecture. Since the top and bottom portions of the screen may be written simultaneously, more time is available to charge the individual column electrodes such as 62, 64, 66 and 68 and still maintain a display rate of 60 frames per second. Also, it takes less time to charge a column electrode which extends slightly less than half way across the screen than it does to charge a full-length column electrode.

The power savings realized by the use of multiple stepwise increases in the modulation voltage could also be obtained using other techniques of placing the modulation voltage on the column or data electrodes. For example, a ramp function could be utilized which would cause the voltage level of the selected data electrodes to ramp upwards from the precharge voltage level to the modulation voltage level within a predetermined allowable time period. The slope of the ramp should be chosen so as to keep current in the resistive element to a minimum; however, the time required to charge each data electrode must not exceed the period defined by the scanning rate divided by the number of row electrodes. Ideally, a constant current source could be used to charge the pixels. This would result in a minimum amount of energy lost as heat through the resistive element. Both the multistep adiabatic charging and the ramp voltage techniques may approximate a constant current charging junction as long as the slope of the ramp and the period of the voltage impulses does not place a voltage on the capacitive pixels at a rate which exceeds the ability of the pixels to accumulate charge. At the same time, however, the charging rate must be fast enough to write data within the constraints of the scanning rate. For example, if 60 frames per second are to be written and if there are 256 row electrodes, all 256 row electrodes must be scanned within 1/60 of a second. Yet another driving waveform for the modulation voltage could be a half sine wave where the period (that is, t/2, where t equals the full sine wave period) is substantially equal to the period of time available for charging each column electrode consistent with the scanning rate. Thus if time T were the period defined by the scanning rate divided by the number of row electrodes t/2 would be made equal to T in order to use half sine wave charging. Like the ramp function and the multistep charging this voltage function approximates a constant current source which minimizes the heat dissipated in the resistive component of the column electrodes. Each data electrode must be charged and discharged within 65 μs; however, driving a column electrode that has been split in half requires only ¼ the time to be fully charged as does a full-length electrode. This is be15 cause the charging time $=2(nR)(nC)=2n^2RC$ for a full-length electrode but the $$\text{charging time} = 2\left(\frac{n}{2}R\right)\left(\frac{n}{2}C\right) = \frac{2n^2RC}{4}$$

for a half-length electrode, thus permitting the use of the above-described power-saving techniques.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An electrode structure for an AC matrix-addressed thin film electroluminescent (TFEL) panel comprising:

(a) a top set of scanning electrodes located in an upper half of said panel and extending from a first edge thereof across the panel to an opposite edge;

(b) a bottom set of scanning electrodes located in a bottom half of the panel and extending from said first edge of the panel across the panel to said opposite edge;

(c) a top set of data electrodes located in said upper half of said panel extending at right angles to said top set of scanning electrodes for a distance slightly less than halfway across said panel;

(d) a bottom set of data electrodes located in a bottom half of said panel extending at right angles to said bottom set of scanning electrodes for a distance of slightly less than halfway across said panel;

(e) scanning electrode driver means for simultaneously energizing scanning electrode pairs, each pair comprising an electrode from said top set and an electrode from said bottom set, in line-by-line fashion; and (f) data electrode driver means for simultaneously energizing selected ones of said top and bottom data electrode sets as each said scanning electrode pair is energized.

2. The electrode structure of claim 1 wherein each electrode in said top set of data electrodes extends across the screen colinearly with a corresponding electrode in said bottom set of data electrodes.

3. The electrode structure of claim 2 wherein said scanning electrode driver means comprises electronic switch means connecting a source of scanning voltage to a pair of scanning electrodes, one electrode in said pair being located in said top set of scanning electrodes and the other electrode in said pair being located in said bottom set of scanning electrodes.

* * * * *